US008266733B2

(12) United States Patent
Jensen

(10) Patent No.: US 8,266,733 B2
(45) Date of Patent: Sep. 18, 2012

(54) TOILET FLUSH VALVE

(75) Inventor: Robert M. Jensen, East Brunswick, NJ (US)

(73) Assignee: AS IP Holdco, LLC, Piscataway, NJ (US)

( * ) Notice: Subject to any disclaimer, the term of this patent is extended or adjusted under 35 U.S.C. 154(b) by 319 days.

(21) Appl. No.: 12/419,277

(22) Filed: Apr. 6, 2009

(65) Prior Publication Data

US 2009/0249537 A1 Oct. 8, 2009

Related U.S. Application Data

(60) Provisional application No. 61/072,969, filed on Apr. 4, 2008.

(51) Int. Cl.
*E03D 1/34* (2006.01)

(52) U.S. Cl. ..... 4/378; 4/379

(58) Field of Classification Search ..... 4/434, 438, 4/392–395, 378, 415
See application file for complete search history.

(56) References Cited

U.S. PATENT DOCUMENTS

| | | | | |
|---|---|---|---|---|
| 1,391,477 | A | 9/1921 | Hinsdale et al. | |
| 3,151,339 | A | 10/1964 | Chase | |
| 3,988,785 | A * | 11/1976 | Schoepe et al. | 251/363 |
| 4,145,776 | A | 3/1979 | Crosby et al. | |
| 4,557,000 | A | 12/1985 | Strangfeld | |
| 4,604,763 | A | 8/1986 | Sprang | |
| 4,651,359 | A | 3/1987 | Battle | |
| 5,040,247 | A | 8/1991 | Stevens | |
| 5,054,133 | A | 10/1991 | Pickerrell et al. | |
| 5,170,515 | A | 12/1992 | Kai et al. | |
| 5,204,999 | A | 4/1993 | Makita et al. | |
| 5,216,761 | A | 6/1993 | Isberg | |
| 5,329,647 | A | 7/1994 | Condon | |
| 5,579,542 | A | 12/1996 | Hayman | |
| 5,694,652 | A | 12/1997 | Stock et al. | |
| 5,983,413 | A | 11/1999 | Hayashi et al. | |
| 6,145,138 | A | 11/2000 | Nakamura et al. | |
| 6,237,164 | B1 | 5/2001 | LaFontaine et al. | |
| 6,415,457 | B2 | 7/2002 | Schmucki | |
| 6,442,772 | B2 | 9/2002 | Han et al. | |
| 6,715,162 | B2 * | 4/2004 | Han et al. | 4/391 |

(Continued)

*Primary Examiner* — Brian Glessner
*Assistant Examiner* — Paola Agudelo
(74) *Attorney, Agent, or Firm* — Flaster/Greenberg PC

(57) ABSTRACT

Flush valve assemblies are provided that include a valve body which may have a radiused inlet portion, an upper inlet end having an inlet opening, a lower outlet end having an outlet opening, and a wall extending between the upper inlet end and the lower outlet end and having an interior surface defining a flow path that extends generally longitudinally through the valve body from the inlet opening to the outlet opening and that has a generally circular transverse cross-section. A height measured longitudinally through the valve body is greater than a largest diameter of the transverse cross-section of the flow path so as to enable the valve bodies herein to have an elevated wall and head from a toilet tank floor. The assemblies may include a flapper valve cover detachably connected to the flush valve assembly and having a transverse cross-sectional diameter sufficiently large to cover the inlet opening of the valve body, a pivot mechanism and a flapper bulb. The flapper valve cover is sufficiently buoyant so as to be capable of resisting the force of flowing water and remain open so as to allow flush water to pass through the valve body when the valve body is installed on a toilet having a flush volume of about 1.6 gallons per flush or less before closing the valve cover so as to be useful in high performance, and also in high-efficiency toilets.

31 Claims, 4 Drawing Sheets

U.S. PATENT DOCUMENTS * cited by examiner

| | | | | |
|---|---|---|---|---|
| 6,728,975 | B2 | 5/2004 | Han | |
| 6,901,610 | B1 | 6/2005 | Jensen et al. | |
| 2006/0185068 | A1 * | 8/2006 | Halloran et al. | 4/378 |
| 2007/0101486 | A1 * | 5/2007 | Torres et al. | 4/392 |

TOILET FLUSH VALVE

CROSS-REFERENCE TO RELATED APPLICATIONS

This application claims the benefit under 35 U.S.C.§119(e) of U.S. Provisional Patent Application No. 61/072,969, filed Apr. 4, 2008, the entire disclosure of which is incorporated herein by reference.

BACKGROUND OF THE INVENTION

1. Field of the Invention

The present invention relates to plumbing in a water closet or toilet water tank of a toilet, and more particularly to a flush valve for use in the water tank of a toilet assembly.

2. Description of Related Art

Toilets and toilet assemblies for removing waste products are well known. Typically, toilets incorporate three systems that work together to perform the flushing action. Those systems are (1) the bowl siphon, (2) the flush mechanism, and (3) the refill mechanism. Working in concert, these three systems enable the flushing function of the toilet.

Usually, the toilet tank, positioned over the back of the toilet bowl in the toilet assembly, holds water that is used to initiate siphoning from the toilet bowl, through a trapway and to a sewage drain line, as well as refilling the bowl with fresh water. When a user wants to flush the toilet, the user pushes down on a flush lever or other flush actuator on the outside of the tank, which is connected on the inside of the tank typically to a movable chain and/or lever. When the flush lever is depressed on the outside of the tank, the chain or lever on the inside of the tank acts to lift and open the flush valve, enabling water to flow from the tank into the bowl, thus initiating the toilet flush.

In many toilet designs, water flows directly into the bowl and can also be dispersed into the rim of the toilet bowl. The water releases into the bowl rather quickly, with flow from the tank into the bowl typically lasting approximately two to four seconds. The water flows from the rim, and down a channel within the sides of the bowl, into the large hole at the bottom of the toilet, known as a siphon jet. The siphon jet releases most of the water into the siphon tube, initiating the siphon action. The siphoning action draws all the water and waste out the bowl, and into the siphon tube. The waste and water continues through the other end of a generally U-shaped siphon tube through an area know as the trapway, and is then released into the wastewater or sewage drain line connected at the base of the toilet.

Once the tank is emptied during the flush, the flush valve is closed, and a floating mechanism, which has now dropped in the tank to some residual amount, initiates the opening of the filler valve. The filler valve provides fresh water to both the tank and the bowl through separate flows. Eventually, the tank fills with water to a high enough level to cause the float to rise, thus shutting off the filler valve. At this point, the flushing cycle is complete.

Government agencies have continually demanded that water use for flushing be reduced. Much of the focus in recent years has been to reduce the water demand required by toilet flushing operations. In order to illustrate this point, the amount of water used in a toilet for each flush has gradually been reduced by governmental agencies from 7 gallons/flush (prior to the 1950's), to 5.5 gallons/flush (by the end of the 1960's), to 3.5 gallons/flush (in the 1980's). The National Energy Policy Act of 1995 mandates that toilets sold in the United States can use water in an amount of 1.6 gallons/flush (6 liters/flush) or less.

One attempt in the art to produce a more reliable, more efficient and more powerful 1.6 gallon (6 liter) gravity flush toilet, known as a "high-performance toilet" (HPT), while overcoming the detriments in toilet technology by increasing the hydraulic energy available during the flushing operation, can be found in U.S. Pat. No. 6,901,610 entitled, "High Performance Valve Assembly For Toilets"; U.S. Pat. No. 6,728,975 entitled, "High Performance Flush Valve Assembly"; and U.S. Pat. No. 6,715,162 for "Toilet Assembly," each of which is co-owned by the owner of the present application. Relevant portions of these patents to the extent they describe radiused inlet technology and general toilet tank operation and construction are incorporated herein by reference.

These patents disclose a flush valve assembly for a water tank of a toilet that includes a valve body secured thereto. The valve body has a base sleeve portion including a radiused inlet to increase the discharge coefficient of the valve opening. A flush cover member is coaxially and slidably mounted with respect to the valve body so that the valve opening is created therebetween when the flush cover member is removed form the valve body via reciprocating motion. The flush cover member is slidably movable between a first position, wherein the flush cover member is seated on the base sleeve portion of the valve body and thereby obstructs water flow through the valve opening, and a second position, wherein the second valve member is removed from the base sleeve portion of the valve body to permit water flow through the valve opening. A sealing member is provided to ensure a proper seal when the flush cover member is in the first position, and a guiding means is provided that properly aligns and guides the flush valve cover relative to the valve body. The flush valve assembly also includes a trip release mechanism that releases the effects of the flush lever on the flush cover member when the flush cover member reaches its second position, thereby returning the flush cover member to its first rest position prior to the flush lever returning to its own corresponding rest position. In this configuration, the disclosed flush valve assembly ensures compliance with the mandated water requirements and simultaneously provides enhanced cleanliness and waste removal capabilities. The flush valve assembly achieves these functions and also releases the effect of the flush lever so that the valve opening can close before the expiration of a regulatory minimum "hold down" time (1 second without exceeding the total water per flush mandate of 1.6 gallons (6 liters)).

Although these prior solutions noted in the above-patents effectively remove waste from toilet bowls within government guidelines, such guidelines no longer mandate a minimum "hold down time". It is therefore desirable to provide the aforementioned benefits in a flush valve assembly having minimal moving parts for ease of manufacturing, installation, operation and maintenance. Such advantage should be incorporated in the flush valve assembly without compromising the water conservation benefits of the prior flush solutions.

Alternative technologies proposed for providing adequate flush valve efficiency for high-performance toilets may be found in U.S. Patent Publication No. 2006-0185068-A1 which proposes the use of a flush valve that has a valve body with a valve seat that defines a flow passage having a portion of its interior flow profile that narrows in a non-linear manner away from the valve seat such that the inner surface of the valve seat in the non-linear portion can be defined by a polynomial expression, i.e., the valve body has a non-linearly curved inner surface.

U.S. Patent Publication 2008-0052812-A1 discloses a flush valve that accomplishes water conservation and flush efficiency, as well as the performance goals noted above, by providing a more efficient combination of a radiused inlet and an optional elevated valve body. The flush valve assembly disclosed therein may also have a "poppet" or centrally aligned and guided buoyant float cover for the valve body. This particular design is highly effective if an upwardly buoyant and centrally guided flush cover is used, because the upward lifting of such a cover provides for water intake into the valve opening in a 360° configuration. That is, when the buoyant cover lifts, it allows for water to flow in from all directions into the valve opening for supplying water from the toilet tank to the toilet bowl.

Problems are encountered when using such an elevated valve body having an optimal radiused inlet designed to enhance flow and maximize hydraulic energy through the valve body with a standard flapper-type valve cover. Such standard flapper valve covers are known in the art, readily available and it would be desirable to be able to use such commercially available covers with a high-efficiency valve body design. Flush valve body assemblies having a radiused inlet and elevated valve body, used with the above-noted, poppet, centrally-guided flush cover, are able to handle the increased efficiency and maximized flow through the valve body at reduced volumes of water so as to be useful as high-performance flush valves working with HPT toilets having toilet bowl designs and flush pathways that achieve the 1.6 gallons/flush water conservation standards, some of which may be qualified as high-efficiency toilets (HET) which provide effective flushing at as low as about 1.28 gallon per flush or even lower.

Using a standard two-inch inlet, the flush volume through a high-efficiency flush valve designed to function with high-efficiency toilets (HETs) is very high, even though the volume in the toilet tank available for flushing is lower than prior art traditional toilets. A traditional flapper valve cover's performance used with such a valve body and a two-inch inlet becomes affected in terms of its ability to close when appropriate, sometimes closing prematurely, and in terms of its ability to re-open. This problem can be exacerbated in a radiused inlet valve body design, because the extension of the inlet opening due to the presence of the radius, which is optimized for high-efficiency flow through the valve body, can require an even larger sized flapper to cover the opening created by the radius thereby contributing to the buoyancy issues affecting opening and closing of the flapper cover. These factors combine to make it difficult to properly open and close a standard flapper on a valve assembly configured for use in an HPT or, preferably an HET and having an elevated valve body and radiused inlet, even in comparison to standard low profile, non-elevated flush valve bodies having standard flapper-type valve covers, for example, a commercially available Fluidmaster® Flush Valve Model 507.

Another problem encountered in prior art flush valve designs is when such flush valves, whether suitable for high-efficiency toilets or not, are optimized for flow design, but have outlets which, when installed introduce fluid flow directly into an inlet chamber of a toilet bowl having a lower floor which lies in a plane perpendicular to the flow coming out of the flush valve outlet. The impact of the contact between the high flow rate through the valve caused by flushing against the floor of the inlet chamber of the toilet bowl introduces undesirable turbulence which reduces the hydraulic energy available from the water exiting the outlet of the flush valve. Prior art designs are available from the owner of the present application in which a fitting is used on the bottom of a flush valve outlet to divide and direct the flush valve outlet flow into two separate directions so as to introduce flow into the a rim area and into the jet area of the toilet bowl. Such designs do avoid some of the impact issue, for certain particular high-efficiency toilet designs.

Based on the foregoing, there is a need in the art for a flush valve that can utilize the advantages of an elevated valve body having a radiused inlet suitable for use in HPTs, and preferably HETs, but which allows for adaptation and use of traditional flapper valve covers. It would also be useful to provide a flush valve assembly configured by using pre-existing commercial flush valves having a lower valve body profile with new detachable sections to provide the same effect as an elevated valve body with a radiused inlet and which can make use of a standard flush valve cover.

There is also a further need in the art for a flush valve that can provide an outlet opening that overcomes the potential hydraulic loss associated with impact on the floor of a toilet bowl inlet chamber but which can be used with any type of toilet bowl design having an inlet chamber therein.

BRIEF SUMMARY OF THE INVENTION

The invention includes a flush valve assembly, comprising, a valve body having a radiused inlet portion, an upper inlet end having an inlet opening therethrough, a lower outlet end having an outlet opening therethrough, and a wall extending between the upper inlet end and the lower outlet end and having an interior surface defining a flow path that extends generally longitudinally through the valve body from the inlet opening to the outlet opening and that has a generally circular transverse cross-section, wherein a height measured longitudinally through the valve body is greater than a largest diameter of the transverse cross-section of the flow path; and a flapper valve cover detachably connected to the flush valve assembly and having a transverse cross-sectional diameter sufficiently large to cover the inlet opening of the valve body, a pivot mechanism having a pivot arm capable of opening and closing the flapper valve cover by a pivot motion upon actuation of a flush activator, and a flapper bulb depending from a lower surface of the flapper valve cover, wherein the flapper valve cover is sufficiently buoyant so as to be capable of resisting the force of flowing water and remain open so as to allow flush water to pass through the valve body when the valve body is installed on a toilet having a flush volume of about 1.6 gallons per flush or less, before closing the valve cover. The flapper valve cover is preferably sufficiently buoyant so as to be capable of resisting the force of flowing water and remain open so as to allow flush water to pass through the valve body when the valve body is installed on a toilet having a flush volume of about 1.28 gallons per flush or less, before closing the valve cover.

The valve body wall in the above-noted flush valve assembly may optionally further comprise an upper inlet section for contacting the flapper valve cover when the valve cover is in the closed position; a base section for attaching to a toilet tank floor; and an extension section situated between the inlet section and the base section. The upper inlet section, the base section and the extension section may be detachably connected to each other, or the upper radiused inlet section, the base section and the extension section may be integrally formed as a unitary structure and variations thereof. In the above-noted assembly, at least one of an interior surface of the base section and the extension section may be tapered so as to have a linearly decreasing diameter from an upper end of each section in a direction towards a lower end of each section, wherein the diameters are measured transversely across each section, and further both of the interior surfaces of the base section and the extension section may be so tapered.

A diameter of the lower outlet end of the valve body is preferably about 2 inches and the flapper valve cover preferably has a buoyant force which is equivalent to a force needed to displace at least about 50 grams of water with air, more preferably at least about 60 grams of water with air and most preferably about 70 grams of water with air.

The radius of the radiused inlet in the above-noted valve assembly may be about ⅛ inch to about ⅜ inch, and is preferably is about ⅜ inch.

The invention further includes a flush valve assembly for a high efficiency toilet, comprising, a valve body having a radiused inlet portion, an upper inlet end having an inlet opening therethrough, a lower outlet end having an outlet opening therethrough, a wall extending between the upper inlet end and the lower outlet end and having an interior surface defining a flow path that extends generally longitudinally through the valve body from the inlet opening to the outlet opening and that has a generally circular transverse cross-section, wherein the wall has an upper inlet section, a base section for attaching to a toilet tank floor, and an extension section situated between the inlet section and the base section, wherein an upper portion of the base section is tapered so as to have a linearly decreasing diameter from an upper end of the base section in a direction towards a lower end of the base section, wherein the diameters of the base section are measured transversely across the base section, wherein a height measured longitudinally through the valve body is greater than a largest diameter of the transverse cross-section of the flow path; and a flapper valve cover detachably connected to the flush valve assembly and having a transverse cross-sectional diameter sufficiently large to cover the inlet opening of the valve body and to contact the upper inlet section of the valve body when the valve cover is closed, a pivot mechanism having a pivot arm capable of opening and closing the flapper valve cover by a pivot motion upon actuation of a flush activator, and a flapper bulb depending from a lower surface of the flapper valve cover, wherein the flapper valve cover is sufficiently buoyant so as to be capable of resisting the force of flowing water and remain open so as to allow flush water to pass through the valve body when the valve body is installed on a toilet having a flush volume of about 1.6 gallons per flush or less, before closing the valve cover. The flapper valve cover may be sufficiently buoyant so as to be capable of resisting the force of flowing water and remain open so as to allow flush water to pass through the valve body when the valve body is installed on a toilet having a flush volume of about 1.28 gallons per flush or less, before closing the valve cover.

In the flush valve assembly noted above, the extension section may be also tapered so as to have a linearly decreasing diameter from an upper end of the extension section to the lower end of the extension section, wherein the diameters of the extension section are measured transversely across the extension section.

A further flush valve assembly is also contemplated as being within the invention which comprises a valve body having a radiused inlet portion, an upper inlet end having an inlet opening therethrough, a lower outlet end having an outlet opening therethrough, and a wall extending between the upper inlet end and the lower outlet end and having an interior surface defining a flow path that extends generally longitudinally through the valve body from the inlet opening to the outlet opening and that has a generally circular transverse cross-section, wherein a height measured longitudinally through the valve body is greater than a largest diameter of the transverse cross-section of the flow path, wherein the wall has a upper inlet section, a base section for attaching to the toilet tank floor, and an extension section situated between the inlet section and the base section and wherein a diameter of the lower outlet end of the valve body is about 2 inches and at least one of an interior surface of the base section and the extension section is tapered so as to have a linearly decreasing diameter from an upper end of each section in a direction toward a lower end of each section, wherein the diameters are measured transversely across each section; and a flapper valve cover detachably connected to the flush valve assembly and having a transverse cross-sectional diameter sufficiently large to cover the inlet opening of the valve body and for contacting the flapper valve cover when the valve cover is closed, a pivot mechanism having a pivot arm capable of opening and closing the flapper valve cover by a pivot motion upon actuation of a flush activator, and a flapper bulb, wherein the flapper valve cover has a buoyant force equivalent to the force needed to displace about 50 grams of water with air.

In such embodiment, the upper inlet section, the base section and the extension section may be detachably connected or the upper inlet section, the base section and the extension section may be integrally formed as a unitary structure and variations thereof.

In the above-noted embodiment, the flapper valve cover preferably has a buoyant force equivalent to the force needed to displace at least about 70 grams of water with air. The base section and the extension section may also have interior surfaces which are tapered, and the radius of the radiused inlet may be about ⅛ inch to about ⅜ inch, and is preferably about ⅜ inch.

The invention further includes a flush valve assembly, comprising, a valve body having an upper inlet end having an inlet opening therethrough, a lower outlet end having an outlet opening therethrough, a radiused outlet portion, a wall extending between the upper inlet end and the lower outlet end and having an interior surface defining a flow path that extends generally longitudinally through an upper inlet portion of the valve body, wherein the flow path has a generally circular transverse cross-section therein, and that extends through the radiused outlet portion; and a valve cover detachably connected to the flush valve assembly and having a transverse cross-sectional diameter sufficiently large to cover the inlet opening of the valve body; and wherein the radiused outlet portion includes a longitudinally depending section of the wall of the valve body and terminates in the lower outlet end of the valve body, wherein the longitudinally depending wall section has a curved elbow portion, wherein the valve body having the radiused outlet portion is configured so as to be capable of directing water through the flow path from a generally downwardly directed longitudinal flow through the upper inlet portion of the valve body, along the curved elbow portion of the radiused outlet portion and into a transversely directed flow upon exiting the lower outlet end of the valve body towards an inlet of a bowl of a toilet assembly, wherein the lower outlet end has a generally semi-circular longitudinal cross-section.

The above-noted embodiment of a valve body may comprise a radiused inlet portion on the upper inlet portion of the valve body, and wherein at least a portion of the interior surface of the valve body is downwardly linearly tapered. The flush valve assembly may also have a valve body which has a diameter measured transversely across the valve body at a location where the valve body would be situated so as to pass through a toilet tank floor when installed on a toilet and above the radiused outlet portion which is about 2 inches, the radiused inlet portion has a radius which is about ⅛ to about ⅜ inch and the valve cover is a flapper valve cover detachably connected to the flush valve assembly and having a transverse cross-sectional diameter sufficiently large to cover the inlet opening of the valve body, a pivot mechanism having a pivot arm capable of opening and closing the flapper valve cover by a pivot motion upon actuation of a flush activator, and a flapper bulb, wherein the flapper valve cover is sufficiently buoyant so as to be capable of resisting the force of flowing water and remain open so as to allow flush water to pass through the valve body when the valve body is installed on a toilet having a flush volume of about 1.6 gallons per flush or less, before closing the valve cover. The flapper valve cover may also be sufficiently buoyant so as to be capable of resisting the force of flowing water and remain open so as to allow flush water to pass through the valve body when the valve body is installed on a toilet having a flush volume of about 1.28 gallons per flush or less, before closing the valve cover.

In the above-noted embodiment of the valve assembly, the valve cover may be a flapper valve cover detachably connected to the flush valve assembly and having a transverse cross-sectional diameter sufficiently large to cover the inlet opening of the valve body, a pivot mechanism having a pivot arm capable of opening and closing the flapper valve cover by a pivot motion upon actuation of a flush activator, and a flapper bulb, and the upper inlet end of the valve body lies in a plane that is at an acute angle with the transverse cross section of the flow path taken at a location in the upper inlet portion of the valve body, wherein the angle is configured so as to create a wider inflow area for water entering the valve body when the flapper valve cover is open to facilitate increased flow of water into the inlet opening of the valve body.

The radiused outlet portion may be detachably connected to the upper inlet portion of the valve body, or integrally formed with the upper inlet portion of the valve body as a unitary structure.

BRIEF DESCRIPTION OF THE SEVERAL VIEWS OF THE DRAWING(S)

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
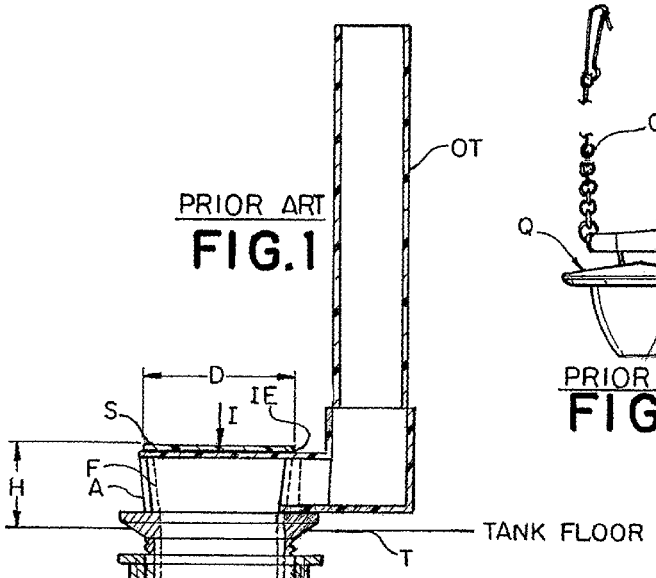
PRIOR ART FIG.1
FIG. 1 is a longitudinal cross-sectional view of a prior art flush valve.

As used herein, words such as "upper" and "lower," "interior" and "exterior," "inner" and "outer," "top" and "bottom," and words of similar import are intended to be used to better understand the invention when explained with reference to directions in the drawings incorporated in this disclosure. They are for illustrative purposes only, are intended to have their ordinary meaning and import, and are not otherwise intended to be limiting with respect to the scope of the invention.

The present invention toilet flush valve assembly can provide a more efficient and more powerful performance for 1.6 gallon (6 liter) or less gravity flush toilets than typical prior art flush valves having a standard flapper cover by increasing the hydraulic energy available during the flushing operation and adapting an elevated valve body and radiused inlet which can work with a flapper cover. A toilet flush valve assembly described herein increases available hydraulic energy by increasing effective flow diameter of the flush valve body inlet opening close to the inlet orifice diameter under dynamic conditions. Moreover, the toilet flush valve assembly has a substantially raised inlet orifice with respect to the tank bottom (i.e., an elevated valve body).

The device is a gravity-type flush valve assembly designed for use in toilet assemblies having a toilet tank for gravity/siphon-based flushing. The flush valve body is preferably formed of a polymeric material, such as a moldable thermoplastic, and constructed to have an interior surface which forms a conduit or flow path from an upper inlet end to a lower outlet end thereby allowing flush water to pass through the flush valve when open. The device preferably has a flush valve cover, preferably a flapper cover pivotally situated in the assembly as to be capable of opening and closing over the flush valve body inlet opening by a pivot motion when actuated by a flush actuator. When closed, the valve body cover prevents the flow of flushing water into the valve until the valve is activated for flushing by means of a trip lever device. When open, flushing water can flow into the valve body along the flow path.

The flush valve assembly may include a standard integrated overflow tube that allows the toilet tank to which the assembly is installed to hold a predetermined volume of water and to also serve as means or pathway to deliver reseal or overflow water to the trap way. Such overflow tubes may be any standard overflow tube and so are not a focus of the disclosure herein. It should be understood that any standard overflow tube or overflow tube to be developed, preferably formed of a polymeric material, and which preferably has protrusions capable of receiving and working with an attachment end of a valve cover, such as a flapper valve cover having a pivot arm may be used within the scope of the invention.

The flush valve assembly may be affixed to the toilet tank via either a projecting threaded stud and nut type arrangement or expandable spud. For the purpose of illustrating the invention, a threaded stud and nut arrangement are used, but should not be considered limiting.

Various preferred embodiments of the invention as described herein include a flared radius, i.e., a radiused inlet portion, having a radius of about ⅛ inch (0.125 inch) to about 1 inch, and more preferably about ⅛ inch (0.125 inch) to about ⅜ inch (0.375 inch), incorporated onto an upper inlet portion of the flush valve body which acts as the sealing surface against which the valve cover, preferably a flapper valve seat contacts and sits. This radiused inlet portion improves the flow characteristics and flow capacity of the flush valve in the flush valve assembly working with the other portions of the flush valve assembly.

In addition, in other embodiments herein, the flush valve assembly can have a radiused outlet portion which acts as a flow director to smoothly change the flow direction of water flowing through the flow path of a flush valve assembly so that the water can pass through the valve body, out the outlet thereof, and into the inlet chamber of a toilet bowl in a toilet assembly with minimal loss of velocity or kinetic energy Embodiments of a flush valve assembly herein can provide a reliable and efficient flush valve for a 1.6 gallon (6 liter) or less gravity flush toilet assembly (HPT), and preferably for a 1.28 gallon or less gravity flush toilet assembly (HET), which has advantages over existing technology and achieves enhanced flushing performance characteristics for use in HPTs, and preferably HETs. Toilet flush valve assemblies described herein can aid in reduction of hydraulic energy loss and be utilized to more effectively remove wastes from the toilet bowl.

As noted above, traditional flush valves are constructed such that their effective flow diameter is less than their inlet orifice diameter under dynamic conditions, i.e., with a low profile valve body and not an elevated valve body configuration. By including the preferred radiused inlet portion with a standard low profile valve body effective diameter can be increased under dynamic conditions with the same orifice diameter.

Further incorporation of a radiused outlet portion having a radius equal to or greater than the radius of the valve conduit on an outlet of the valve assembly may improve the flow rate to critical flow paths within the toilet flushing system i.e., water sent to a rim area from an inlet chamber by approximately 25% in some cases.

In a typical existing installation of a flush valve assembly, the outlet is positioned some predetermined height above the inlet chamber floor of a toilet bowl inlet chamber, wherein the floor of the chamber runs perpendicularly to the longitudinal axis of the valve body so as to form a blunt transition for water entering the toilet bowl from the flush valve assembly. During operation, the water flowing through the valve impacts this blunt transition creating turbulent flow, thus, increasing hydraulic losses and thusly reducing the flow rate or energy available effecting flushing performance. By using an optional radiused outlet portion as described further herein below, such loss can be minimized or eliminated.

To fully utilize the various embodiments of the invention described herein, it is also preferred that the entire hydraulic flushing system (i.e., the hydraulic pathways within the toilet bowl as well as the flush valve body and the outlet thereof) should be optimized as to take full advantage of the various embodiments of the flush valve assemblies described herein, and preferably the toilets used with such assemblies are also high-performance toilets able to meet current industry flush volume standards of 1.6 gallons per flush or less, and more preferably high efficiency toilets capable of functioning with about 1.28 gallons per flush or less, although it will be understood that such flush valve assemblies can be easily used with standard toilet designs as well and provide performance benefits.

Figure 1A:
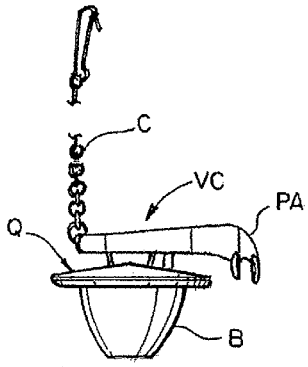
PRIOR ART FIG. 1A
FIG. 1A is a side elevational view of a prior art flapper cover for use with a prior art flush valve as in FIG. 1 for forming a prior art flush valve assembly.

In a standard prior art flush valve body A with overflow tube OT for use in a standard prior art flush valve assembly as shown in FIG. 1, the valve body A has a height H above the toilet tank floor T when installed which is much less than a largest diameter D of the valve body A and provides a low profile valve body. The tapered interior surface S, which in one section of the valve body above the tank floor near the inlet end IE tapers linearly downwardly from an upper inlet end IE of the valve body in a direction towards the lower end of the valve body to aid in the flow characteristics. The flow path F follows a tapered profile when viewed in a longitudinal cross-section in the inlet portion of the valve body above the tank floor and a straight profile as the valve body transitions below the tank floor T to the outlet end OE. A standard prior art flapper valve cover VC is shown in FIG. 1A and has a standard bulb B and a pivot arm PA. The pivot arm PA is attached to the top Q of the valve cover VC and includes a link for attachment to a chain C that can be used to lower and raise the valve cover VC through actuation of any standard valve actuator (not shown) such as a flush handle and lever, etc. In use, the pivot art PA of the prior art valve cover VC is attached to the overflow tube using a standard connection that protrudes from the overflow tube and opens and closes over the inlet opening I in the inlet end IE of the valve body A in response to actuation of, for example, a flush handle.

Figure 2:
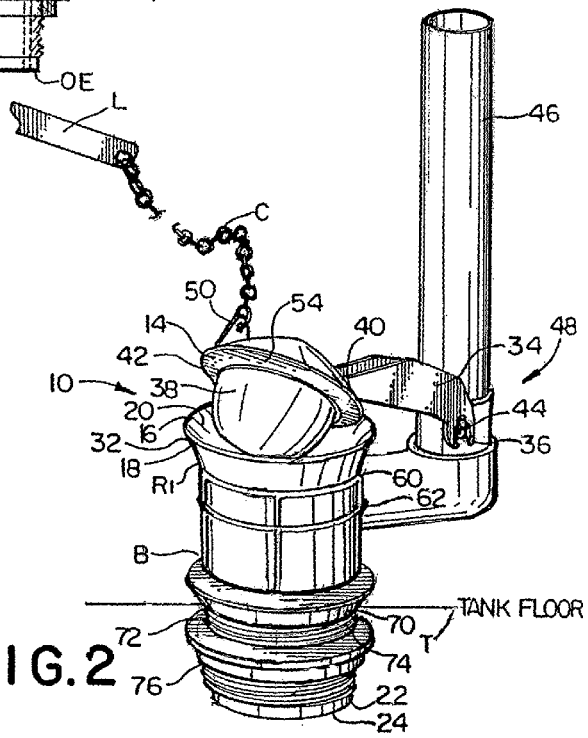
FIG. 2 is a perspective view of a flush valve assembly according to an embodiment of the invention.
Figure 3:
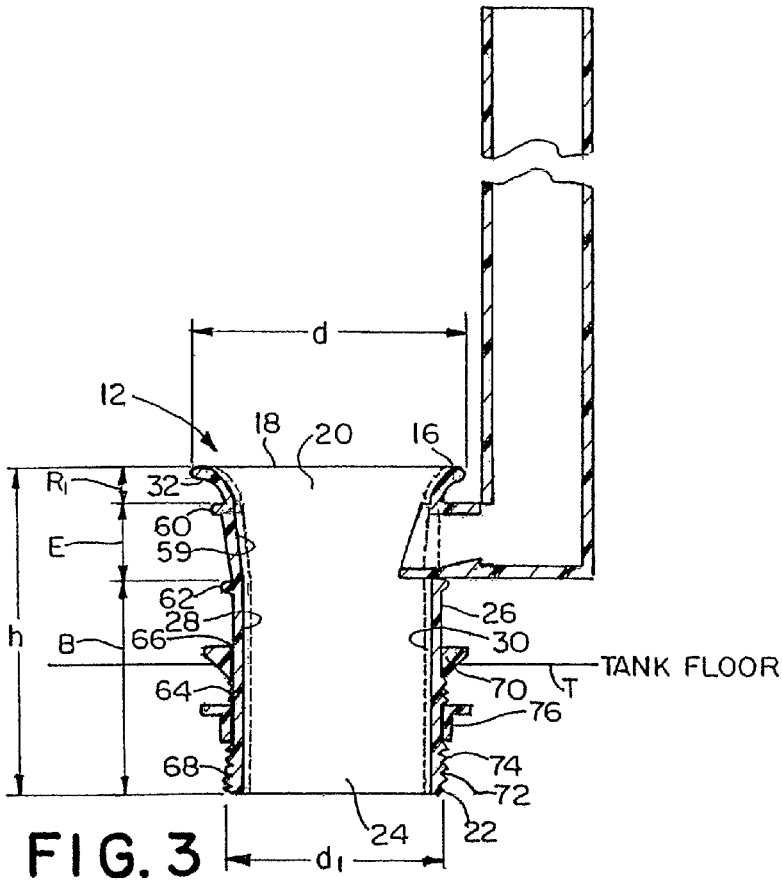
FIG. 3 is a longitudinal cross-sectional view of the flush valve in the flush valve assembly of FIG. 2.
Figure 4:
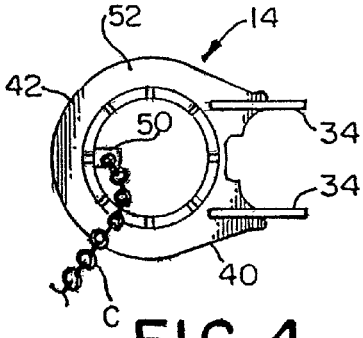
FIG. 4 is a top plan view of the flapper valve cover in the assembly of FIG. 2.
Figure 7:
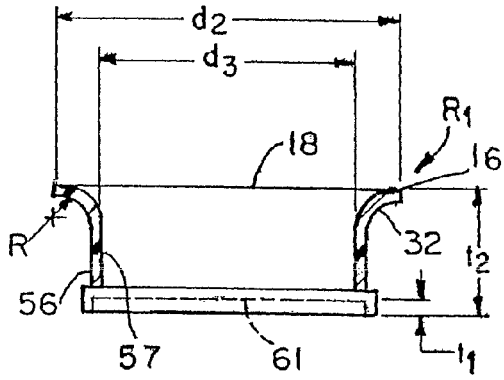
FIG. 7 is a side elevational view of a detachable upper inlet portion having a radiused inlet portion therein for use in forming a valve body as shown in FIG. 2.

FIG. 2 shows a first embodiment of a flush valve assembly described herein. The flush valve assembly, generally referred to herein as 10, has a valve body 12 and a valve cover 14. The valve body may be formed of a variety of materials and is preferably a molded polymeric material, such as a thermoplastic, suitable for use in a water environment in a toilet tank. The valve body has a preferred radiused inlet portion 16 which extends annularly around the upper inlet end 18 of the valve body. The radiused inlet portion has a curved arcuate profile which in a longitudinal cross section, for example as shown in FIGS. 3 and 7, preferably forms a circular segment having a radius R which can be measured under the curved lower surface 32 of the radiused inlet portion. The radiused inlet portion provides a curved inlet so that water flowing in curves over the radiused inlet into the valve body. It also provides a larger inlet area on the upper inlet end 18 of the valve body. The radius R of the radiused inlet may be varied from about ⅛ inch to about 1 inch, but is preferably about ⅛ inch to about ⅜ inch, and most preferably about ⅜ inch when the diameter of the lower outlet end 22 is about 2 inches.

The valve body has a wall 26 that extends between an upper inlet end 18 and a lower outlet end 22 of the valve body. The ends are preferably situated so that upon installation the upper inlet end 18 is located in a tank of a toilet and the lower end 22 is located below a tank floor T as shown in FIGS. 2 and 3. An inlet opening 20 extends through the upper inlet end 18, wherein the inlet opening is preferably generally circular in transverse cross section. As used herein, generally circular means a curved configuration such as a circle, oval, elliptical or egg-shaped configuration, preferably circular. The wall 26 may be an integrally formed wall such as to form a unitary structure valve body or may be formed of segments as discussed herein. It should also be understood that the certain segments of the wall may be integrally formed together while others can be made to be detachably connected. The segments of the wall body may thus be molded together, formed as separate piece(s) and fused or detachably connected to one another, such as by chamfering (described elsewhere herein with respect to the radiused inlet), snap-lock edge fittings, detents, screws, bolts, interlocking snap-fit pieces, connectors, and the like. Any suitable connection mechanism for adjoining the pieces may be used, provided the pieces form a tight fit and are leak-resistant. To assist in being leak-resistant, if separate pieces are joined together through mechanical mechanisms (such as screws, fittings, connectors and the like), it is preferred that a sealing member (such as a standard elastomeric or plastic O-ring or gasket suitable for plumbing use) is placed between adjoining pieces. Such sealing members are optional if the pieces form a leak-tight fit and are not needed if the pieces are fused or molded together.

The wall has an interior surface 28 extending the length of the valve body wall that defines the flow path 30. The flow path 30 takes the shape of the interior surface of the body wall and extends through the entire inner space of the valve body so as to create a flow path profile when viewed in longitudinal cross section through the valve body. The flow path 30 also has a generally circular transverse cross section along the valve body, however, as explained elsewhere herein, the diameter of the cross section can vary over the length of the flow path. As used herein, "diameter" means the longest measure across the generally circular cross section.

The valve body 12 is preferably an elevated valve body. The height h measured longitudinally along the valve body is greater than the largest diameter d of the transverse cross-section of the flow path (in this case measured at the radiused inlet). This configuration allows for installation of the valve body in the toilet tank so as to provide for an elevated valve body portion lying above the toilet tank floor T. This configuration raises the flow rate through the valve body over standard valve bodies and creates more dynamic flow through the valve body while achieving the same head (distance from the upper surface of the tank water to the "choke" point or point of construction of the valve body).

The precise height h of the valve body may be varied, but it is preferred that the height h is sufficient so that the length of the valve body above the tank floor T is larger than a standard low profile valve body and preferably approximates or is greater than the largest diameter d. The height h is preferably greater than about 2.8 inch and can be as much as about 5.2 inches, and more preferably is about 3.5 inches to about 4.1 inches. The diameter d is greater than about 2.0 inches, and preferably is about 2.25 inches to about 3.5 inches, more preferably about 2.4 inches to about 3.3 inches and most preferably about 3.2 inches to about 3.25 inches. The ratio of the height h to the diameter d is preferably about 2.3 to about 0.8 and more preferably about 1.7 to about 1.1.

The valve assembly 10 further includes a valve cover 14, which is preferably a flapper valve cover. The cover 14 is preferably detachably connected to the valve assembly 10. The valve body cover preferably has a pivot arm(s) 34 that extends outwardly from a first end section 40 of the valve body cover 14 so as to able to connect to a standard protruding arm 44 on an overflow tube 46 as part of a pivot mechanism 48. The overflow tube 46 may be configured in the same manner as standard prior art overflow tubes which are well known in the art or may have the configuration of any later developed and improved overflow tubes. The overflow tube 46 described herein can be used in any of the various embodiments described herein and sized to have connectors and fittings which interlock with and empty into an inlet tube into the valve body in a manner also known in the art. Accordingly, further description of such overflow tubes with respect to each of the other embodiments herein is omitted.

The flapper cover 14 once connected to the assembly as shown in FIG. 2 is capable of opening and closing by a pivot motion upon actuation of a flush actuator, such as a flush handle (not shown) or the like, which operates a lever L such as shown in FIG. 2. The lever L may have a standard flush chain C (of any chain design) attached to an end thereof. The other end of the chain C may be attached to a grommet or other linkage 50 on a second end 42 of the cover on an upper surface 52 thereof. Upon flushing, the chain C pulls upwards so as to open the flapper cover 14 and allow water to flow into the inlet opening 20 of the valve body. The flush cover is kept upon by buoyant forces during flushing, and when flushing is complete, the flush cover closes so that a seal 54 on a lower surface of the valve cover seals against the radiused inlet 16, so that upon refilling, and additional flush water cannot enter the valve until the next flush cycle. When the toilet float hits its lower level, and the flapper valve is closed a fill mechanism in the toilet (not shown) is activated and water again fills the tank.

Figure 5:
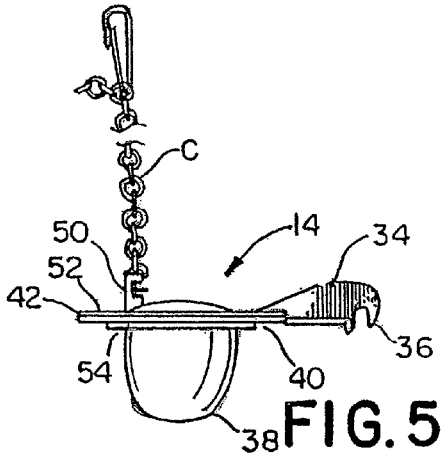
FIG. 5 is a side elevational view of the flapper valve cover of FIG. 4.

The flapper valve cover is preferably sufficiently large so as to cover the inlet opening 20 for closing the valve body and preferably is slightly larger so as to contact and close across the radiused inlet. The flapper valve has a bulb which is shaped so as to substantially fill the valve opening 20 and which upon installation of an HPT or preferably an HET, is configured (e.g., has a shape, weight and rigidity) so as to create a buoyant force equivalent to the force required to displace at least about 50 grams of water with air, preferably at least about 60 grams of water with air, and most preferably at least about 70 grams of water with air, when the valve body is sized so as to have a diameter $d_1$ at the outlet end 22 of the valve body 12 which is about 2 inches. In such a design, the height h ranges from about 2.8 inches to about 5.2 inches as noted above. As shown in FIG. 5, the bulb is preferably somewhat larger than a standard flapper flush valve and has a generally cylindrical shape (i.e., has a generally rectangular or square longitudinal cross sectional configuration) having rounded corners on a lower end thereof.

This configuration as well as adequate rigidity allows for the flapper to work with the smaller sized 2 inch flush valve having a radiused inlet and an elevated valve body as described herein. It is preferred that the flapper valve cover has sufficient buoyancy so when the flapper valve cover is opened and a high volume of flush water passes through the valve body, the valve cover is able to resist the high volume of water and stay open long enough for the volume of flush water to pass through the valve body when installed on an HPT, or preferably an HET, before closing. In such a manner, the flapper valve cover can function effectively with the high-performance, and preferably high-efficiency valve body design for use in HPT and preferably HET toilets as described herein. While the above-noted parameters can achieve that goal, it should be understood that one can modify the flapper design to adjust for the buoyancy of the valve cover if there are variations in the configuration of the elevated valve body or radiused inlet, such as by modifying the height of the valve body or the diameter $d_1$.

As noted above, the valve body 12 may be configured so that the diameter of the flow path is not constant along its length. The valve body 12 preferably includes an upper inlet section $R_1$, a base section B, and an extension section E situated between the base section B and the inlet section $R_1$. The upper inlet section $R_1$ of the valve body in FIG. 3 includes the radiused inlet portion 16 and may or may not have a downwardly extending wall segment such as segment 56 in FIG. 7 which shows a detachable upper inlet section $R_1$. The downwardly extending wall segment 56 is preferably configured so that the interior surface 57 is perpendicular to the toilet tank floor T and the edge of the lower outlet end when the valve body is installed. However, it may also be tapered below the radiused inlet portion to be downwardly linearly tapered so as to have a decreasing diameter as measured transversely across the valve body below the radiused inlet portion.

As shown in FIG. 7, the upper inlet section $R_1$ has a largest diameter $d_2$ which is preferably equivalent to d in FIG. 3 and an interior flow path diameter $d_3$ in the downwardly extending wall segment 56 which is preferably equivalent to diameter $d_1$. If formed as a detachable piece, a chamfered section can be formed in the lower end thereof for fitting over the extension section E. The chamfered section 61 can have a thickness $t_1$ measured longitudinally of about 0.04 inches to about 0.2 inches, which fits by any interlocking manner known in the art into the top of the extension section E. The thickness $t_2$ of the upper inlet section $R_1$ can be adjusted for varying flow profiles and for providing a varying overall valve body height, however, the height which can be used is limited by space constraints in the tank into which the valve assembly is installed. Preferred thicknesses $t_2$ of the inlet section are preferably about ⅛ inch to about 2.1 inch, and more preferably about 0.9 inch to about 1.1 inches.

The extension section E can have a flow profile formed by an interior surface 59 thereof which is perpendicular to the toilet tank floor T or the lower outlet end 22 of the valve body 12, but which may also be downwardly linearly tapered so as to have a decreasing diameter as measured transversely across the valve body from an upper end 60 of the extension section to the lower end 62 of the extension section. The thickness/height of the extension section can also be varied, within the constraints of the toilet tank area available for the valve body installation and can be formed integrally with the upper inlet section or detachable thereto.

A base section B forms the remaining section of the valve body 12 from the extension section E to the lower outlet end 22 of the valve body for attaching the valve body to the toilet tank floor T, so that a portion of the base section B is above the tank floor T and a portion is below the tank floor T when the valve body is installed on the tank. The base section B has an interior surface 64 which forms a flow path that may be completely straight and perpendicular to the tank floor T or the outlet end 22 of the valve body throughout base section B, or may have at least a portion which lies above the tank floor T on installation of the valve body which is also tapered in a linearly downward direction from an upper end 66 in a direction towards a lower end 68 of the base section B.

The base section B, preferably also includes a sealing ring 70 to seat the valve body 12 against the opening in the tank floor T. The outer surface 72 of the valve body along the base portion is preferably threaded so as to have threads 74 for receiving a locking connection ring 76 or similar device for securing the seal against the tank. While a ring, threaded end and locking connector are shown herein, it should be understood based on the disclosure that other locking and sealing mechanisms may be used within the scope of the invention.

Figure 6:
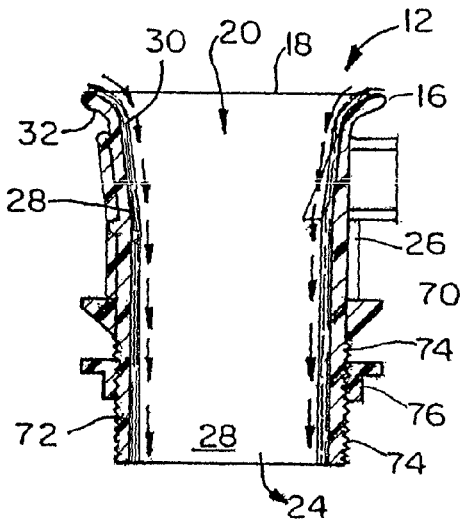
FIG. 6 is a longitudinal cross-sectional view of the flush valve body of FIG. 3 highlighting the configuration of the flow path.

As shown in FIG. 6, a highlight of the flow path 30 profile of the valve body 12 is shown demonstrating flow that curves around a radiused inlet portion in the inlet section of the valve body, flows in a direction perpendicular to the tank floor T on installation through the extended wall portion of the inlet section, flows in a downward linearly tapered manner through the extension section and flows in a direction perpendicular to the tank floor T on installation through the straight base section.

Figure 8:
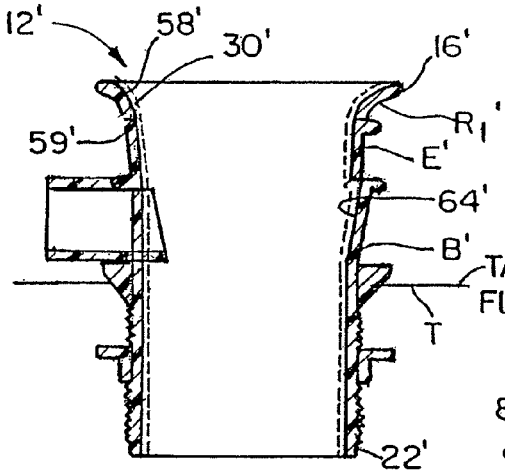
FIG. 8 is a longitudinal cross-sectional view of a valve body for use in a flush valve assembly in an alternative embodiment of the invention.

FIG. 8 shows a variation of the valve body having a radiused inlet 16' in an upper inlet section $R_1$' that is connected to an extension section E' having an interior surface 59' with a non-tapered or straight flow path, i.e., the extension section E' is generally tubular. A base section B' has an interior surface 64' which is partially tapered along a portion thereof to create a partially linearly tapered flow path in an area above the tank floor T, and a portion that extends through the tank floor to the lower outlet 22' of the valve body 12' that has a generally tubular configuration, i.e., a generally circular cross section and a flow path perpendicular to the tank floor T on installation. The flow path 30' profile of FIG. 8 curves along the radiused inlet, then flows downwardly perpendicular to the tank floor through the inlet and extension sections, tapers inwardly through a portion of the base section and then flows perpendicularly to the tank floor through the remainder of the base section below the tank floor.

The invention further includes radiused outlet portions which may be used with flush valve bodies such as the flush valve assemblies as are described hereinabove within the scope of the invention, or with standard valve bodies in flush valve assemblies known in the art. The radiused outlet portions described herein for use with varying valve body configurations for flush valve assemblies may be formed integrally as part of a unitary structure or affixed to one piece of a valve body from which it depends, or may be a separate detachable piece that can be used as a fitting on any available valve body provided it is able to fit below the tank floor and into an inlet chamber of a toilet bowl in a toilet assembly.

Figure 9:
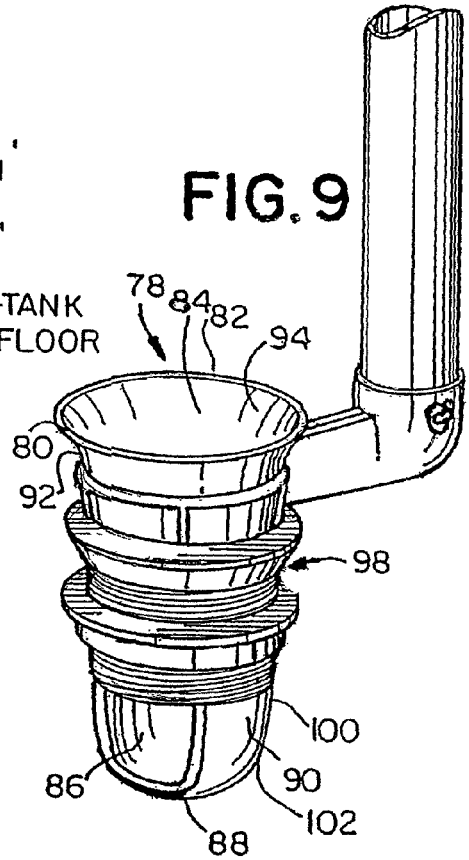
FIG. 9 is a perspective view of a valve body for a flush valve assembly according to another embodiment of the invention having a radiused outlet portion.
Figure 10:
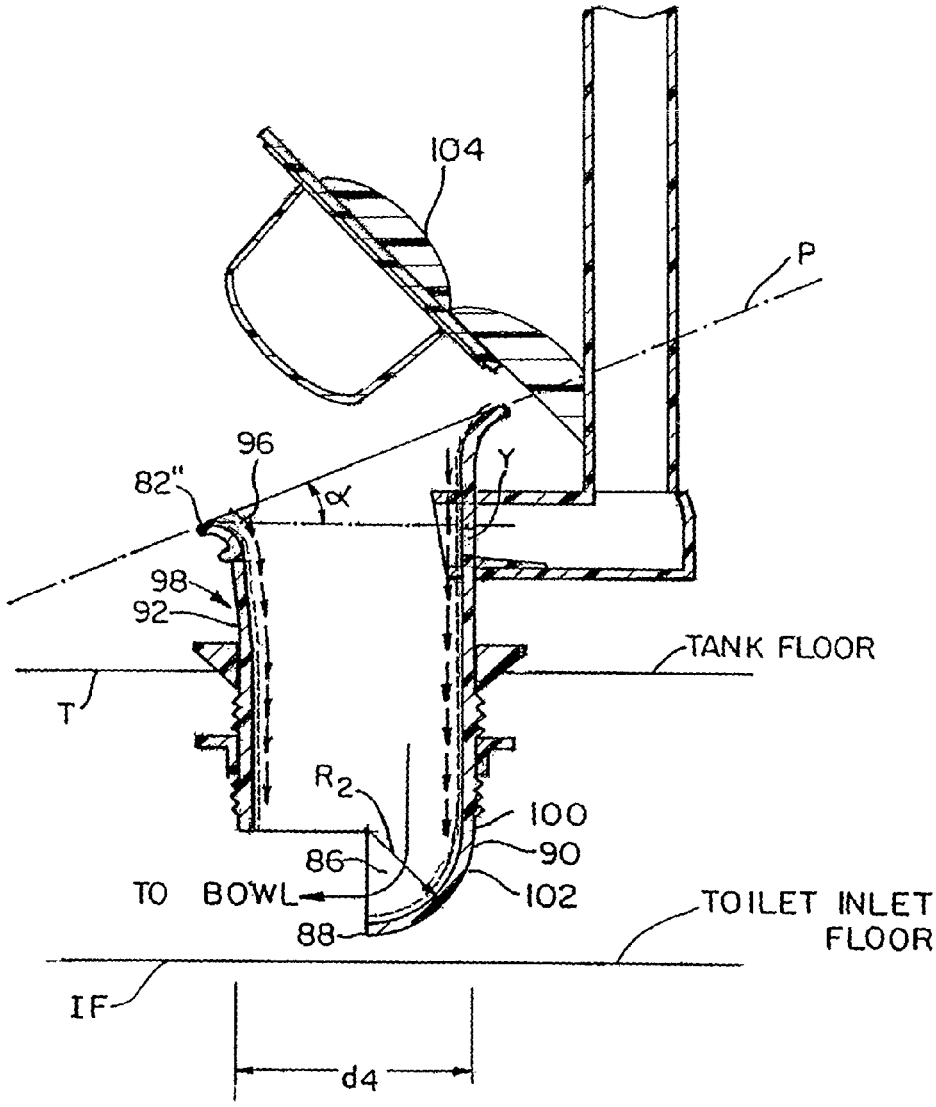
FIG. 10 is a longitudinal cross-sectional view of flush valve assembly having the valve body of FIG. 9.

One preferred embodiment using a flush valve body similar to those described herein is shown in FIG. 9. FIG. 10 shows an embodiment that is the same as FIG. 9 but for its upper inlet as described below but in all other respects is the same. To the extent the embodiments in FIGS. 9 and 10 vary, it is described below. The valve body 78 of FIG. 9 has an upper inlet end 82 having an inlet opening 84 therethrough, a lower outlet end 88 having an outlet opening 86 therethrough. The valve body 78 also has a radiused outlet portion 90. The valve body 78 has a wall 92 extending between the upper inlet end 82 and the lower outlet end 88 and an interior surface 94 that defines the flow path 96 through the valve body 78. The flow path extends generally longitudinally through an upper inlet portion 98 of the valve body, although sections of the valve body 78 within the upper inlet portion 98 may be tapered. Such tapering is best shown in the embodiment of FIG. 10 (which in this respect is the same as FIG. 9) and wherein the valve body 78 may have an upper inlet section, an extension section and a base section as discussed above with respect to the valve bodies 12 in the valve assemblies 10 of the invention, and at least one or more of such sections may be tapered as discussed above as well.

The flow path 96 also preferably has a generally circular transverse cross section within the upper inlet portion 98 so that the flow of water through the flow path extends through the upper inlet portion 98 to the radiused outlet portion 90 and ultimately through the outlet opening 86. The flow path in FIGS. 9 and 10 varies only with respect to the configuration of the upper portion of the radiused inlet in the inlet section thereof, wherein in FIG. 10, additional flow volume may be accommodated through the slanted upper inlet end thereof.

The radiused outlet portion of the embodiments of FIGS. 9 and 10 are the same and are formed from a depending section 100 of the wall 92. The depending section 100 extends downwardly and then curves so as to terminate in the lower outlet end 88 of the valve body 78. In curving, the depending wall section 100 has a curved elbow portion 102 which forms a turn or "scoop" effect on the bottom of the radiused outlet portion 90. The radiused outlet portion is configured so as to be capable of changing the direction of the flow path 96 so that water is directed through the flow path from a generally downwardly directed longitudinal flow through the upper inlet portion 98 of the valve body 78 (with the understanding that some portions thereof may be tapered) then along the curved elbow portion 102 and finally into a generally transversely extending direction upon exiting the lower outlet end 88 of the valve body 78. Such transversely flowing water then may enter a toilet bowl in a toilet bowl assembly, such as through an inlet chamber or manifold below the toilet tank floor T without impacting a lower inlet floor IF of such chamber in a perpendicular manner. Instead the flow would pass easily and in a more laminar manner into the inlet chamber or manifold of a toilet bowl in a toilet assembly (not shown).

FIGS. 9 and 10 show the configuration of the outlet opening of the valve body as having a longitudinal cross-section that is generally semi-circular and further shows a radius $R_2$ in the radiused outlet. The radiused outlet can be sized depending on the space available below the tank floor and so as to extend as low as practical or desirable for the flow profile of an inlet chamber of a toilet bowl into which it is configured to extend. The radius $R_2$ is preferably about one half of the diameter $d_4$ of the valve body measured along a lower portion of the base section of the valve body.

In a preferred embodiment as shown in FIGS. 9 and 10, the valve body 78 having the radiused outlet portion 90 may also have a radiused inlet 80 so as to optimize and maximize hydraulic flow and resist loss of hydraulic energy through the valve body 89. If the valve body is being used in a HPT or an HET as is preferred and has a valve body diameter $d_4$ along a lower portion of the base section of the valve body as noted above of about size of 2 inches, it is preferred, as with the valve bodies of the flush valve assemblies 12 shown elsewhere herein, that the radius of the radiused inlet 80 is sized as noted above, preferably about ⅛ inch to about ⅜ inch. When using a flapper valve cover such as valve cover 104 shown in FIG. 10 with the valve body 78 (although the flapper valve cover may be varied), in view of the flow path and use of the radiused outlet, in the variation shown in FIG. 10, the valve body 78 has an upper inlet end 82" that is not generally parallel to the tank floor as shown in FIG. 9, but which lies in a plane P at an acute angle $\alpha$ formed by the plane P and a further plane taken through the transverse cross section of the flow path 96 at a location Y in the upper inlet portion 98 of the valve body. The angle $\alpha$ is configured so as to create a wider inflow area for water entering the valve body and a larger volume in the upper inlet section of the valve body to facilitate increased flow of water into the inlet opening of the valve body when using a pivoting flapper valve cover 104. The flapper valve cover 104 is preferably the same as flapper valve cover 14 described elsewhere herein.

The invention will now be described with respect to the following non-limiting example.

EXAMPLE

A series of valve bodies were prepared by interchanging inlet sections so as to have a radiused inlet or no radiused inlet, to have tapered and non-tapered extension sections as well as tapered and non-tapered base sections. The flow properties were compared to flow properties through a standard commercially available 2-inch Fluidmaster® 507 valve having a low profile and a straight bore flow profile, operating with a flapper valve cover at optimal flush volumes for such a valve (Comparative Standard Sample CE). The results of the varying sample valve bodies combined with varying flapper valve covers of differing buoyancy levels show the impact of a radiused inlet as being beneficial, as well as the benefit of including at least one tapered section therein, and most preferably including such features with a sufficiently buoyant flapper valve cover capable of having a buoyant force equivalent to the force necessary to displacing about 70 grams of water with air, provided significantly enhanced flow properties.

The valve body samples were numbered from 1 to 9. The samples were each tested using a sample laboratory simulated toilet tank in combination with a flush inlet filling mechanism, a lever in connection with a flush handle and a standard chain. In samples 1 to 8, the chain was attached to two varying flapper cover designs A and B, wherein A was a Fluidmaster® 502 flapper cover having a buoyant force equivalent to the force needed to displace about 54 grams of water with air and B was an R&T Coast Foundary flapper valve having a buoyant force equivalent to the force needed to displace about 46 grams of water with air. For preferred valve body sample 9, the valve body was tested with flapper valve cover A and with a preferred valve cover C made as described herein having a bulb with a generally cylindrical configuration and rounded corners (generally rectangular longitudinal cross section) and having a buoyant force equivalent to the force needed to displace about 70 grams of water with air. The general configuration of each of the samples 1-9 is listed in Table 1 below. If a radiused inlet was used (according to the preferred invention herein), the inlet section of the valve body has a radiused inlet and extending wall section that was perpendicular to the tank floor, and if no radiused inlet was used, the upper inlet section was simply tapered or straight in accordance with the extension section as described. In Table 1, if a radiused inlet is used, the radius as measured in inches is provided.

TABLE 1

| Sample | Radius (inch) | Extension Section | Base Section Above Tank Floor |
|---|---|---|---|
| 1 | ⅛ | Tapered | Tapered |
| 2 | ⅛ | Tapered | Perpendicular |
| 3 | 3/16 | Tapered | Tapered |
| 4 | ¼ | Tapered | Tapered |
| 5 | — | Perpendicular | Tapered |
| 6 | — | Tapered | Tapered |
| 7 | ⅛ | Perpendicular | Tapered |
| 8 | — | Tapered | Perpendicular |
| 9 | ⅜ | Tapered | Perpendicular |

Table 2 shows the various parameters for the Comparative Sample CE and Samples 1-9 using Flappers A, B and C and at varying water levels for each flapper cover (Sample 9 did not work adequately with Flapper A cover using the higher water level. As can be seen tapering along at least a portion of the valve body, having an elevated valve body profile, a radiused inlet and a sufficiently buoyant flapper valve cover, as shown best in Sample 9 using Flapper C provides marked flow improvement and allows for incorporation of approximately a 2 inch valve body with a radiused inlet and elevated valve body and having a flapper-type cover for use in HPT, and preferably HET toilets using lower flush volumes for flushing and having maximum hydraulic performance through the flush valve assembly while minimizing hydraulic losses.

TABLE 2

| | | Sample: | | | | | | | | | | | |
|---|---|---|---|---|---|---|---|---|---|---|---|---|---|
| | | CE | | | | 1 | | | | 2 | | | |
| Flapper: | | A | | B | | A | | B | | A | | B | |
| Water Level | 1 | 7.18 | 8.13 | 7.18 | 8.13 | 7.18 | 8.13 | 7.18 | 8.13 | 7.3 | 8.25 | 7.3 | 8.25 |
| | 2 | 7.18 | 8.13 | 7.18 | 8.13 | 7.18 | 8.13 | 7.18 | 8.13 | 7.3 | 8.25 | 7.3 | 8.25 |
| | 3 | 7.18 | 8.13 | 7.18 | 8.13 | 7.18 | 8.13 | 7.18 | 8.13 | 7.3 | 8.25 | 7.3 | 8.25 |
| Avg. | | 7.18 | 8.13 | 7.18 | 8.13 | 7.18 | 8.13 | 7.18 | 8.13 | 7.3 | 8.25 | 7.3 | 8.25 |
| Flapper Shut Off | 1 | 3 | 3 | 3 | 3 | 4 | 4 | 4.25 | 4 | 4 | 4 | 4 | 4 |
| | 2 | 3 | 3 | 3 | 3 | 4 | 4 | 4.25 | 4 | 4 | 4 | 4 | 4 |
| | 3 | 3 | 3 | 3 | 3 | 4 | 4 | 4.25 | 4 | 4 | 4 | 4 | 4 |
| Avg. | | 3 | 3 | 3 | 3 | 4 | 4 | 4.25 | 4 | 4 | 4 | 4 | 4 |
| Main Flush Volume | 1 | 7760 | 9562 | 7892 | 9702 | 6092 | 8016 | 6256 | 8096 | 6440 | 8184 | 6414 | 8250 |
| | 2 | 7776 | 9560 | 7886 | 9724 | 6166 | 7998 | 6278 | 8114 | 6498 | 8180 | 6466 | 8242 |
| | 3 | 7804 | 9528 | 7868 | 9716 | 6222 | 7982 | 6214 | 8138 | 6502 | 8202 | 6492 | 8212 |
| Avg. | | 7780 | 9550 | 7882 | 9714 | 6160 | 7999 | 6249 | 8116 | 6480 | 8189 | 6457 | 8235 |
| Range | | 44 | 34 | 24 | 22 | 130 | 34 | 64 | 42 | 62 | −18 | −26 | −38 |
| Break | 1 | 0.65 | 0.70 | 0.65 | 0.65 | 2.75 | 0.60 | 0.60 | 0.65 | 0.65 | 0.65 | 0.60 | 0.60 |
| Time | 2 | 0.65 | 0.65 | 3.90 | 0.75 | 2.60 | 0.65 | 0.65 | 0.65 | 0.65 | 0.65 | 0.60 | 0.65 |
| | 3 | 3.85 | 0.60 | 0.65 | 0.65 | 0.62 | 0.70 | 0.65 | 0.65 | 0.65 | 0.65 | 0.60 | 0.65 |
| Peak Discharge Rate | 1 | 3684 | 3932 | 3620 | 4096 | 3892 | 4816 | 4148 | 4672 | 4076 | 4632 | 4120 | 4512 |
| | 2 | 3564 | 3880 | 3536 | 3852 | 4020 | 4696 | 4168 | 4540 | 4088 | 4628 | 4024 | 4564 |
| | 3 | 3524 | 3960 | 3600 | 3884 | 4292 | 4580 | 4280 | 4708 | 3992 | 4572 | 4148 | 4620 |
| Avg. | | 3591 | 3924 | 3585 | 3944 | 4068 | 4697 | 4199 | 4640 | 4052 | 4611 | 4097 | 4565 |
| Increase % | | — | — | — | — | 13% | 20% | 17% | 18% | 13% | 17% | 14% | 16% |
| Peak Time | 1 | 0.55 | 0.55 | 0.55 | 0.55 | 0.75 | 0.50 | 0.50 | 0.55 | 0.50 | 0.55 | 0.55 | 0.55 |
| | 2 | 0.55 | 0.55 | 0.55 | 0.65 | 0.55 | 0.55 | 0.55 | 0.55 | 0.55 | 0.55 | 0.50 | 0.55 |
| | 3 | 0.60 | 0.55 | 0.50 | 0.55 | 0.55 | 0.55 | 0.55 | 0.55 | 0.55 | 0.55 | 0.50 | 0.55 |
| Avg. | | 0.57 | 0.55 | 0.53 | 0.58 | 0.62 | 0.53 | 0.53 | 0.55 | 0.53 | 0.55 | 0.52 | 0.55 |

| | | Sample: | | | | | | | | | | | |
|---|---|---|---|---|---|---|---|---|---|---|---|---|---|
| | | 3 | | | | 4 | | | | 5 | | | |
| Flapper: | | A | | B | | A | | B | | A | | B | |
| Water Level | 1 | 7.18 | 8.13 | 7.18 | 8.13 | 7.18 | 8.13 | 7.18 | 8.13 | 7.18 | 8.13 | 7.18 | 8.13 |
| | 2 | 7.18 | 8.13 | 7.18 | 8.13 | 7.18 | 8.13 | 7.18 | 8.13 | 7.18 | 8.13 | 7.18 | 8.13 |
| | 3 | 7.18 | 8.13 | 7.18 | 8.13 | 7.18 | 8.13 | 7.18 | 8.13 | 7.18 | 8.13 | 7.18 | 8.13 |
| Avg. | | 7.18 | 8.13 | 7.18 | 8.13 | 7.18 | 8.13 | 7.18 | 8.13 | 7.18 | 8.13 | 7.18 | 8.13 |
| Flapper Shut Off | 1 | 4.13 | 4.06 | 4 | 4 | 4 | 3.88 | 4 | 4 | 4 | 4 | 3.88 | 4 |
| | 2 | 4.13 | 4.06 | 4 | 4 | 4 | 3.88 | 4 | 4 | 4 | 4 | 3.88 | 4 |
| | 3 | 4.13 | 4.06 | 4 | 4 | 4 | 3.88 | 4 | 4 | 4 | 4 | 3.88 | 4 |
| Avg. | | 4.13 | 4.06 | 4 | 4 | 4 | 3.88 | 4 | 4 | 4 | 4 | 3.88 | 4 |
| Main Flush Volume | 1 | 5764 | 7724 | 5626 | 7640 | 6024 | 8098 | 5956 | 7930 | 6232 | 7960 | 6412 | 7930 |
| | 2 | 5658 | 7788 | 5678 | 7698 | 5984 | 8048 | 5940 | 7970 | 6184 | 8112 | 6394 | 7970 |
| | 3 | 5720 | 7796 | 5706 | 7634 | 6036 | 8028 | 5938 | 7998 | 6212 | 8102 | 6420 | 7998 |
| Avg. | | 5714 | 7769 | 5670 | 7657 | 6015 | 8058 | 5945 | 7966 | 6209 | 8058 | 6409 | 7966 |
| Range | | 106 | 72 | 80 | 64 | 52 | 70 | 18 | 68 | 48 | 142 | 26 | 68 |
| Break | 1 | 2.15 | 2.70 | 0.65 | 0.70 | 0.65 | 0.65 | 0.70 | 0.70 | 3.15 | 0.70 | 0.60 | 0.70 |
| Time | 2 | 2.15 | 0.65 | 0.60 | 0.65 | 0.65 | 0.70 | 0.65 | 0.70 | 3.05 | 0.65 | 0.65 | 0.70 |
| | 3 | 0.80 | 2.75 | 2.20 | 0.70 | 2.40 | 0.65 | 0.65 | 0.65 | 0.70 | 0.65 | 0.70 | 0.65 |
| Peak Discharge Rate | 1 | 4220 | 4956 | 4588 | 5268 | 4512 | 5100 | 4408 | 4944 | 3404 | 3824 | 3364 | 4944 |
| | 2 | 4452 | 5072 | 4612 | 5160 | 4396 | 5172 | 4524 | 4860 | 3424 | 3856 | 3640 | 4860 |
| | 3 | 4604 | 4680 | 4412 | 5144 | 4456 | 5104 | 4524 | 5112 | 3524 | 3840 | 3564 | 5112 |
| Avg. | | 4425 | 4903 | 4537 | 5191 | 4455 | 5125 | 4485 | 4972 | 3451 | 3840 | 3523 | 4972 |
| Increase % | | 23% | 25% | 26% | 32% | 24% | 31% | 25% | 27% | −4% | −2% | −2% | 27% |
| Peak Time | 1 | 0.50 | 0.55 | 0.55 | 0.55 | 0.55 | 0.50 | 0.60 | 0.55 | 0.55 | 0.60 | 0.50 | 0.55 |
| | 2 | 0.55 | 0.55 | 0.50 | 0.55 | 0.55 | 0.55 | 0.55 | 0.55 | 0.55 | 0.55 | 0.55 | 0.55 |
| | 3 | 0.70 | 0.55 | 0.55 | 0.60 | 0.55 | 0.55 | 0.55 | 0.55 | 0.60 | 0.55 | 0.60 | 0.55 |
| Avg. | | 0.58 | 0.55 | 0.53 | 0.57 | 0.55 | 0.53 | 0.57 | 0.55 | 0.57 | 0.57 | 0.55 | 0.55 |

| | | Sample: | | | | | | | |
|---|---|---|---|---|---|---|---|---|---|
| | | 6 | | | | 7 | | | |
| Flapper: | | A | | B | | A | | B | |
| Water Level | 1 | 7.31 | 8.25 | 7.31 | 8.25 | 7.31 | 8.13 | 7.25 | 8.13 |
| | 2 | 7.31 | 8.25 | 7.31 | 8.25 | 7.31 | 8.13 | 7.25 | 8.13 |
| | 3 | 7.31 | 8.25 | 7.31 | 8.25 | 7.31 | 8.13 | 7.25 | 8.13 |
| Avg. | | 7.31 | 8.25 | 7.31 | 8.25 | 7.31 | 8.13 | 7.25 | 8.13 |
| Flapper Shut Off | 1 | 4.25 | 4.25 | 4.25 | 4.25 | 4 | 4 | 4 | 4 |
| | 2 | 4.25 | 4.25 | 4.25 | 4.25 | 4 | 4 | 4 | 4 |
| | 3 | 4.25 | 4.25 | 4.25 | 4.25 | 4 | 4 | 4 | 4 |
| Avg. | | 4.25 | 4.25 | 4.25 | 4.25 | 4 | 4 | 4 | 4 |

TABLE 2-continued

| | | | | | | | | |
|---|---|---|---|---|---|---|---|---|
| Main Flush Volume | 1 5586 | 7428 | 5590 | 7468 | 6172 | 7920 | 6094 | 8204 |
| | 2 5660 | 7514 | 5676 | 7544 | 6160 | 8022 | 6322 | 8190 |
| | 3 5680 | 7444 | 5670 | 7476 | 6210 | 7924 | 6164 | 8218 |
| Avg. | 5642 | 7462 | 5645 | 7496 | 6181 | 7955 | 6193 | 8204 |
| Range | 94 | 86 | 86 | 76 | 50 | 102 | 228 | 14 |
| Break Time | 1 0.70 | 0.65 | 0.60 | 0.70 | 3.15 | 0.65 | 0.75 | 0.65 |
| | 2 2.45 | 3.00 | 2.40 | 0.75 | 3.15 | 0.65 | 0.80 | 0.70 |
| | 3 0.80 | 0.75 | 2.40 | 0.75 | 0.65 | 0.70 | 0.75 | 0.80 |
| Peak Discharge Rate | 1 4044 | 4572 | 3928 | 4384 | 3284 | 3812 | 3528 | 3824 |
| | 2 4028 | 4388 | 4004 | 4436 | 3368 | 3736 | 3580 | 3812 |
| | 3 4064 | 4440 | 4028 | 4432 | 3344 | 3792 | 3572 | 3728 |
| Avg. | 4045 | 4467 | 3987 | 4417 | 3332 | 3780 | 3560 | 3788 |
| Increase % | 13% | 14% | 11% | 13% | −7% | −4% | −1% | −3% |
| Peak Time | 1 0.60 | 0.55 | 0.55 | 0.60 | 0.60 | 0.55 | 0.65 | 0.55 |
| | 2 0.60 | 0.55 | 0.60 | 0.65 | 0.55 | 0.50 | 0.70 | 0.60 |
| | 3 0.70 | 0.65 | 0.55 | 0.65 | 0.55 | 0.60 | 0.65 | 0.70 |
| Avg. | 0.63 | 0.58 | 0.57 | 0.63 | 0.57 | 0.55 | 0.67 | 0.62 |

| | | Sample: | | | | | | |
|---|---|---|---|---|---|---|---|---|
| | | 8 | | | | 9 | | |
| Flapper: | | A | | | B | A | | B |
| Water Level | 1 | 7.38 | 8.13 | 7.38 | 8.13 | 7.25 | 7.25 | 8.13 |
| | 2 | 7.38 | 8.13 | 7.38 | 8.13 | 7.25 | 7.25 | 8.13 |
| | 3 | 7.38 | 8.13 | 7.38 | 8.13 | 7.25 | 7.25 | 8.13 |
| Avg. | | 7.38 | 8.13 | 7.38 | 8.13 | 7.25 | 7.25 | 8.13 |
| Flapper Shut Off | 1 | 4 | 4 | 4 | 4 | 4.25 | 4.38 | 4.5 |
| | 2 | 4 | 4 | 4 | 4 | 4.25 | 4.38 | 4.5 |
| | 3 | 4 | 4 | 4 | 4 | 4.25 | 4.38 | 4.5 |
| Avg. | | 4 | 4 | 4 | 4 | 4.25 | 4.38 | 4.5 |
| Main Flush Volume | 1 | 6470 | 7968 | 6560 | 8148 | 5352 | 4938 | 6880 |
| | 2 | 6436 | 8012 | 6586 | 8204 | 5416 | 5120 | 6988 |
| | 3 | 6420 | 8050 | 6588 | 8216 | 5548 | 5150 | 6816 |
| Avg. | | 6442 | 8010 | 6578 | 8189 | 5439 | 5069 | 6895 |
| Range | | 50 | 82 | 28 | 68 | 196 | 212 | −64 |
| Break Time | 1 | 0.65 | 0.65 | 0.60 | 0.65 | 0.70 | 0.80 | 0.70 |
| | 2 | 0.65 | 0.65 | 3.35 | 0.65 | 0.65 | 0.70 | 2.50 |
| | 3 | 0.65 | 0.60 | 0.65 | 0.65 | 0.65 | 1.80 | 0.75 |
| Peak Discharge Rate | 1 | 3548 | 3656 | 3344 | 3804 | 4972 | 5119 | 5824 |
| | 2 | 3380 | 3812 | 3284 | 3652 | 4896 | 5248 | 5646 |
| | 3 | 3512 | 3564 | 3344 | 3616 | 5124 | 5188 | 5576 |
| Avg. | | 3480 | 3677 | 3324 | 3691 | 4997 | 5185 | 5682 |
| Increase % | | −3% | −6% | −7% | −6% | 39% | 44% | 45% |
| Peak Time | 1 | 0.60 | 0.55 | 0.55 | 0.55 | 0.60 | 0.65 | 0.60 |
| | 2 | 0.55 | 0.55 | 0.50 | 0.55 | 0.55 | 0.55 | 0.55 |
| | 3 | 0.55 | 0.50 | 0.55 | 0.55 | 0.55 | 0.55 | 0.65 |
| Avg. | | 0.57 | 0.53 | 0.53 | 0.55 | 0.57 | 0.58 | 0.60 |

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A flush valve assembly, comprising, a valve body having a radiused inlet portion, an upper inlet end having an inlet opening therethrough, a lower outlet end having an outlet opening therethrough, and a wall extending between the upper inlet end and the lower outlet end and having an interior surface defining a flow path that extends generally longitudinally through the valve body from the inlet opening to the outlet opening and that has a generally circular transverse cross-section, wherein at least a portion of the wall is downwardly linearly tapered and has a decreasing valve body diameter as measured transversely across the valve body, and the tapered wall portion is below the radiused inlet portion, wherein a height measured longitudinally through the valve body is about the same as or greater than a largest diameter of the transverse cross-section of the flow path; and a flapper valve cover detachably connected to the flush valve assembly and having a transverse cross-sectional diameter sufficiently large to cover the inlet opening of the valve body, a pivot mechanism having a pivot arm capable of opening and closing the flapper valve cover by a pivot motion upon actuation, and a flapper bulb depending from a lower surface of the flapper valve cover, wherein the flapper valve cover is sufficiently buoyant so as to be capable of resisting the force of flowing water and remain open so as to allow flush water to pass through the valve body when the valve body is installed on a toilet having a flush volume of about 1.6 gallons per flush or less, before closing the valve cover.

2. The flush valve assembly according to claim 1, wherein the flapper valve cover is sufficiently buoyant so as to be capable of resisting the force of flowing water and remain open so as to allow flush water to pass through the valve body when the valve body is installed on a toilet having a flush volume of about 1.28 gallons per flush or less, before closing the valve cover.

3. The flush valve assembly according to claim 1, wherein the valve body wall further comprises:

an upper inlet section for contacting the flapper valve cover when the valve cover is in the closed position;

a base section for attaching to a toilet tank floor; and an extension section situated between the inlet section and the base section.

4. The flush valve assembly according to claim 3, wherein the upper inlet section, the base section and the extension section are detachably connected.

5. The flush valve assembly according to claim 3, wherein the upper radiused inlet section, the base section and the extension section are integrally formed as a unitary structure.

6. The flush valve assembly according to claim 3, wherein the at least a portion of the wall that is downwardly linearly tapered is located on an interior surface of one of the base section or the extension section.

7. The flush valve assembly according to claim 6, wherein the at least a portion of the wall that is downwardly linearly tapered is located on an interior surface of both the base section and the extension section.

8. The flush valve assembly according to claim 1, wherein a diameter of the lower outlet end of the valve body is about 2 inches and the flapper valve cover has a buoyant force which is equivalent to a force needed to displace at least about 50 grams of water with air.

9. The flush valve assembly according to claim 8, wherein the flapper valve cover has a buoyant force which is equivalent to force needed to displace at least about 60 grams of water with air.

10. The flush valve assembly according to claim 9, wherein the flapper valve cover has a buoyant force which is equivalent to force needed to displace at least about 70 grams of water with air.

11. The flush valve assembly according to claim 8, wherein a radius of the radiused inlet is about ⅛ inch to about ⅜ inch.

12. The flush valve assembly according to claim 11, wherein the radius of the radiused inlet is about ⅜ inch.

13. The flush valve assembly according to claim 1, wherein the radius of the radiused inlet is about ⅛ inch to about ⅜ inch.

14. The flush valve assembly according to claim 13, wherein the radius of the radiused inlet is about ⅜ inch.

15. A flush valve assembly for a high efficiency toilet, comprising, a valve body having a radiused inlet portion, an upper inlet end having an inlet opening therethrough, a lower outlet end having an outlet opening therethrough, a wall extending between the upper inlet end and the lower outlet end and having an interior surface defining a flow path that extends generally longitudinally through the valve body from the inlet opening to the outlet opening and that has a generally circular transverse cross-section, wherein the wall has an upper inlet section, a base section for attaching to a toilet tank floor, and an extension section situated between the inlet section and the base section, wherein an upper portion of the base section is tapered so as to have a linearly decreasing diameter from an upper end of the base section in a direction towards a lower end of the base section, wherein the diameters of the base section are measured transversely across the base section, wherein a height measured longitudinally through the valve body is about the same as or greater than a largest diameter of the transverse cross-section of the flow path; and a flapper valve cover detachably connected to the flush valve assembly and having a transverse cross-sectional diameter sufficiently large to cover the inlet opening of the valve body and to contact the upper inlet section of the valve body when the valve cover is closed, a pivot mechanism having a pivot arm capable of opening and closing the flapper valve cover by a pivot motion upon actuation of a flush activator, and a flapper bulb depending from a lower surface of the flapper valve cover, wherein the flapper valve cover is sufficiently buoyant so as to be capable of resisting the force of flowing water and remain open so as to allow flush water to pass through the valve body when the valve body is installed on a toilet having a flush volume of about 1.6 gallons per flush or less, before closing the valve cover.

16. The flush valve assembly according to claim 15, wherein the flapper valve cover is sufficiently buoyant so as to be capable of resisting the force of flowing water and remain open so as to allow flush water to pass through the valve body when the valve body is installed on a toilet having a flush volume of about 1.28 gallons per flush or less, before closing the valve cover.

17. The flush valve assembly according to claim 15, wherein the extension section is also tapered so as to have a linearly decreasing diameter from an upper end of the extension section to the lower end of the extension section, wherein the diameters of the extension section are measured transversely across the extension section.

18. A flush valve assembly, comprising, a valve body having a radiused inlet portion, an upper inlet end having an inlet opening therethrough, a lower outlet end having an outlet opening therethrough, and a wall extending between the upper inlet end and the lower outlet end and having an interior surface defining a flow path that extends generally longitudinally through the valve body from the inlet opening to the outlet opening and that has a generally circular transverse cross-section, wherein a height measured longitudinally through the valve body is about the same as or greater than a largest diameter of the transverse cross-section of the flow path, wherein the wall has a upper inlet section, a base section for attaching to the toilet tank floor, and an extension section situated between the inlet section and the base section and wherein a diameter of the lower outlet end of the valve body is about 2 inches and at least one of an interior surface of the base section and the extension section is tapered so as to have a linearly decreasing diameter from an upper end of each section in a direction toward a lower end of each section, wherein the diameters are measured transversely across each section; and a flapper valve cover detachably connected to the flush valve assembly and having a transverse cross-sectional diameter sufficiently large to cover the inlet opening of the valve body and for contacting the flapper valve cover when the valve cover is closed, a pivot mechanism having a pivot arm capable of opening and closing the flapper valve cover by a pivot motion upon actuation, and a flapper bulb, wherein the flapper valve cover has a buoyant force equivalent to the force needed to displace about 50 grams of water with air.

19. The flush valve assembly according to claim 18, wherein the upper inlet section, the base section and the extension section are detachably connected.

20. The flush valve assembly according to claim 18, wherein the upper inlet section, the base section and the extension section are integrally formed as a unitary structure.

21. The flush valve assembly according to claim 20, wherein the flapper valve cover has a buoyant force equivalent to the force needed to displace at least about 70 grams of water with air.

22. The flush valve assembly of claim 18, wherein both of the base section and the extension section have interior surfaces which are tapered.

23. The flush valve assembly according to claim 18, wherein a radius of the radiused inlet is about ⅛ inch to about ⅜ inch.

24. The flush valve assembly according to claim 23, wherein the radius of the radiused inlet is about ⅜ inch.

25. A flush valve assembly, comprising, a valve body having an upper inlet end having an inlet opening therethrough, a lower outlet end having an outlet opening therethrough, a radiused outlet portion, a wall extending between the upper inlet end and the lower outlet end and having an interior surface defining a flow path that extends generally longitudinally through an upper inlet portion of the valve body, wherein the flow path has a generally circular transverse cross-section therein, and that extends through the radiused outlet portion; and a valve cover detachably connected to the flush valve assembly and having a transverse cross-sectional diameter sufficiently large to cover the inlet opening of the valve body; and wherein the radiused outlet portion includes a longitudinally depending section of the wall of the valve body and terminates in the lower outlet end of the valve body, wherein the longitudinally depending wall section has a curved elbow portion, wherein the valve body having the radiused outlet portion is configured so as to be capable of directing water through the flow path from a generally downwardly directed longitudinal flow through the upper inlet portion of the valve body, along the curved elbow portion of the radiused outlet portion and into a transversely directed flow upon exiting the lower outlet end of the valve body towards an inlet of a bowl of a toilet assembly, wherein the lower outlet end has a generally semi-circular longitudinal cross-section.

26. The flush valve assembly according to claim 25, wherein the valve body comprises a radiused inlet portion on the upper inlet portion of the valve body, and wherein at least a portion of the interior surface of the valve body is downwardly linearly tapered.

27. The flush valve assembly according to claim 26, wherein the valve body has a diameter measured transversely across the valve body at a location where the valve body would be situated so as to pass through a toilet tank floor when installed on a toilet and above the radiused outlet portion which is about 2 inches, the radiused inlet portion has a radius which is about ⅛ to about ⅜ inch and the valve cover is a flapper valve cover detachably connected to the flush valve assembly and having a transverse cross-sectional diameter sufficiently large to cover the inlet opening of the valve body, a pivot mechanism having a pivot arm capable of opening and closing the flapper valve cover by a pivot motion upon actuation, and a flapper bulb, wherein the flapper valve cover is sufficiently buoyant so as to be capable of resisting the force of flowing water and remain open so as to allow flush water to pass through the valve body when the valve body is installed on a toilet having a flush volume of about 1.6 gallons per flush or less, before closing the valve cover.

28. The flush valve assembly according to claim 27, wherein the flapper valve cover is sufficiently buoyant so as to be capable of resisting the force of flowing water and remain open so as to allow flush water to pass through the valve body when the valve body is installed on a toilet having a flush volume of about 1.28 gallons per flush or less, before closing the valve cover.

29. The flush valve assembly according to claim 25, wherein the valve cover is a flapper valve cover detachably connected to the flush valve assembly and having a transverse cross-sectional diameter sufficiently large to cover the inlet opening of the valve body, a pivot mechanism having a pivot arm capable of opening and closing the flapper valve cover by a pivot motion upon actuation, and a flapper bulb, and the upper inlet end of the valve body lies in a plane that is at an acute angle with the transverse cross section of the flow path taken at a location in the upper inlet portion of the valve body, wherein the angle is configured so as to create a wider inflow area for water entering the valve body when the flapper valve cover is open to facilitate increased flow of water into the inlet opening of the valve body.

30. The flush valve assembly according to claim 25, wherein the radiused outlet portion is detachably connected to the upper inlet portion of the valve body.

31. The flush valve assembly according to claim 25, wherein the radiused outlet portion is integrally formed with the upper inlet portion of the valve body as a unitary structure.

* * * * *